United States Patent [19]

Stewart et al.

[11] Patent Number: 4,872,002

[45] Date of Patent: Oct. 3, 1989

[54] INTEGRATED MATRIX DISPLAY CIRCUITRY

[75] Inventors: Roger G. Stewart, Neshanic Station; Dora Plus, S. Bound Brook, both of N.J.

[73] Assignee: General Electric Company, Princeton, N.J.

[21] Appl. No.: 150,817

[22] Filed: Feb. 1, 1988

[51] Int. Cl.[4] ..... G09G 3/20

[52] U.S. Cl. ..... 340/811; 340/784; 340/825.79

[58] Field of Search ..... 340/825.79, 825.80, 340/718, 719, 783–788, 811, 812, 813

[56] References Cited

U.S. PATENT DOCUMENTS

| | | | |
|---|---|---|---|
| 3,862,360 | 1/1975 | Dill et al. | 340/719 |
| 4,110,662 | 8/1978 | Greeneich et al. | 340/719 |
| 4,604,617 | 8/1986 | Morozumi | 340/805 |
| 4,633,242 | 12/1986 | Sekiya | 340/719 |
| 4,635,127 | 1/1987 | Togashi | 358/236 |
| 4,740,782 | 4/1988 | Aoki et al. | 340/719 |

OTHER PUBLICATIONS

M. Akiyama, et al., "An Active-Matrix LCD with Integrated Driver Circuits Using a-Si TFT/s" Japan Display '86, 1986, pp. 212–215.

P. R. Malmberg et al., "Active-Matrix Liquid-Crystal Display with Integrated Scanner Electronics," SID 86 Digest, 1986, pp. 281–284.

M. Yoshimura et al., "High-Resolution VFD On-a--Chip" SID 86 Digest, 1986, pp. 403–406.

T. De Rycke et al., "The Design and Simulation of Poly-CdSe TFT Driving Circuits for High Resolution LC Displays" Japan Display '86, 1986, pp. 304–307.

K. Kasano et al "A 240-Character Vacuum Fluorescent Display and its Drive Circuitry" Proc of the SID, vol. 21/2, 1980 pp. 107–111.

T. Yamazaki et al "A Liquid Crystal TV Display Panel with Drivers" SID Disgest, 1982, pp. 48–49.

T. Gielow, et al "Multiplex Drive of a Thin Film El Panel" SID 84 Digest, 1984 pp. 242–244.

*Primary Examiner*—David K. Moore

*Assistant Examiner*—Jeffery A. Brier

*Attorney, Agent, or Firm*—Joseph S. Tripoli; Eric P. Herrmann; James B. Hayes

[57] ABSTRACT

Integrated latch circuitry for driving row or column busses of a matrix device fabricated in low mobility semiconductor material includes cross coupled transistors having variable impedance load devices. The cross coupled transistors are coupled between relatively positive and relatively negative supply potentials. The relatively negative supply potential is modulated to preset the state of the latches in order to reduce the load on input circuitry applying data to the latch. The variable impedance loads are modulated between relatively high and relatively low impedances to enhance the speed at which the latches change state.

10 Claims, 10 Drawing Sheets

FROM
MASTER
CONTROLLER

MC
2
36
C
R
COUNTER
C
30
ADD
ROM
C
32
34
C
MUX
$I_c$
$\bar{I}_c$
37
C
MUX
$D_c$
$\bar{D}_c$
AMPS
38
C
MUX
$C_c$
$\bar{C}_c$
OSC
31
FREQUENCY
DIVIDER
33
35
28

INTEGRATED MATRIX DISPLAY CIRCUITRY

This invention relates to integral circuitry for operating self-scanned matrix display apparatus.

BACKGROUND OF THE INVENTION

Many display devices, such as liquid crystal displays, consist of a matrix of active elements, or pixels, arranged in vertical columns and horizontal rows. The data to be displayed are applied as drive voltages to data lines which are respectively associated with ones of the columns of active elements. The rows of active elements are sequentially scanned and the individual active elements within the addressed row are illuminated in accordance with the amplitude of the data voltage applied to the respective column.

Typically, the flat panel display matrix will consist of several hundred rows and several hundred columns. In order to minimize the number of interconnections to the display it is desirable to incorporate row and column scanning or multiplexing circuitry integrally with the display. Currently, thin-film-transistor (TFT) circuitry is being used by a number of companies to integrate display and addressing circuitry on common substrates. The materials that are being used to fabricate the TFT circuitry are cadmium selenide (CdSe), polycrystalline silicon (poly-Si) and amorphous silicon (A-Si).

The advantage of using poly-Si is its high carrier mobility. Its disadvantages include a narrow spectrum of useable substrate material, relatively high leakage currents, and an excessively high processing temperature.

CdSe has a relatively high carrier mobility and requires lower temperatures to fabricate (Tmax<400° C.). However, it has proven difficult to produce devices with uniform parametric characteristics over a display device.

Amorphous silicon is amenable to fabrication at low temperatures (Tmax<350° C.) on a variety of inexpensive substrate materials. A-Si transistors are simple to fabricate with uniform parametric characteristics across an array. However, the carrier mobility ($\mu < 1$ cm$^2$/VS) is at least an order of magnitude slower than CdSe and poly-Si. The carrier mobility of A-Si is too slow to permit construction of scanning circuitry with conventional designs.

At the current state of the art of integrated flat panel displays, were it not for its low carrier mobility, A-Si would probably be the material of choice for display manufacture.

Scanning circuits for flat-panel display devices have been fabricated in A-Si using conventional circuit designs. An example of this type of scanning circuitry in A-Si is presented in a paper entitled "An Active-Matrix LCD With Integrated Driver Circuits Using A-Si TFTs" by M. Akiyama et al. in Japan Display '86, Proceedings of the 6th International Display Research Conference, September, 1986, at pages 212–215. The device described is a liquid crystal display incorporating an integral A-Si tapped shift register with buffer drivers for scanning the rows in the display matrix. The matrix columns are driven by circuitry external to the display device. The paper provides preliminary test results including output voltage waveforms of the A-Si row scanner. The test data indicates (a) that the maximum frequency of operation is about 30 kHz and (b) that the fall time (i.e. the turn off time) of the shift register scanner approaches 20 $\mu$ sec even for relatively small area display devices.

Firstly, while the 20 $\mu$ sec fall time of the row scanner may be acceptable to develop images, a faster fall time is more desirable in order to develop sharper images. Secondly, the 30 kHz frequency limit indicates that a shift register type of scanning arrangement is incapable of performing fast data multiplexing for the display column busses.

A TFT scanner, for commutating the video signal to be displayed to the matrix column busses, is illustrated in the paper "The Design and Simulation of Poly-CdSe TFT Driving Circuits for High Resolution LC Displays" by I. DeRyche, A VanCalster, J. Vanfleteren and A. DeClercq, JAPAN DISPLAY '86, Proceedings of the 6th International Display Research Conference, September 1986, pp. 304–307. This scanner was fabricated with the relatively high mobility material CdSe and includes, a serial-input-parallel-output data shift register, a plurality of data latches each coupled to respective ones of the shift register parallel outputs and associated with a respective one of the matrix column busses, and a plurality of buffer amplifiers each of which has an input coupled to an output of a corresponding latch and an output coupled for driving a column bus. In this arrangement, the shift register is coupled to the latches by a first set of gating devices and the latches are coupled to the buffer amplifiers by a second set of gating devices.

During a given line period, the data stored in the latches are applied, via the buffer amplifiers, to the respective column busses. Concurrently data, or video signal, for the next line of display is serially loaded into the shift register at approximately a 6 MHz clock rate. At the end of a given line period, the data in the shift register is transferred in parallel to the plurality of latches. This data is then coupled to the column busses during the next subsequent line interval.

In light of the speed-performance characteristics reported by M. Akiyama et al., for shift registers fabricated with A-Si, it will readily be appreciated that the commutating circuitry of the type presented by I. DeRyche et al. cannot be fabricated in A-Si and expected to operate at the requisite scanning speeds to drive the vertical columns of a flat panel display device.

Thus, there is a need for commutating circuitry which can be fabricated in materials having relatively low carrier mobility and which can be operated at relatively high rates.

SUMMARY OF THE INVENTION

The present invention is directed toward latch circuitry for applying signals to matrix type display devices. The latch circuitry includes a pair of cross coupled transistors energized by variable impedance load devices. The variable impedance load devices are modulated between low impedance high current modes and high impedance low current modes to effect factor switching of the latch circuitry.

DETAILED DESCRIPTION

The invention will be described in the environment of a self scanned liquid crystal display apparatus wherein the active elements are manufactured using amorphous silicon material. It should be appreciated, however, that the inventive concepts are applicable to other types of apparatus requiring scanning or commutating circuitry in which conventional scanning circuitry is incapable of being operated at the desired speed of operation.

Figure 1A:
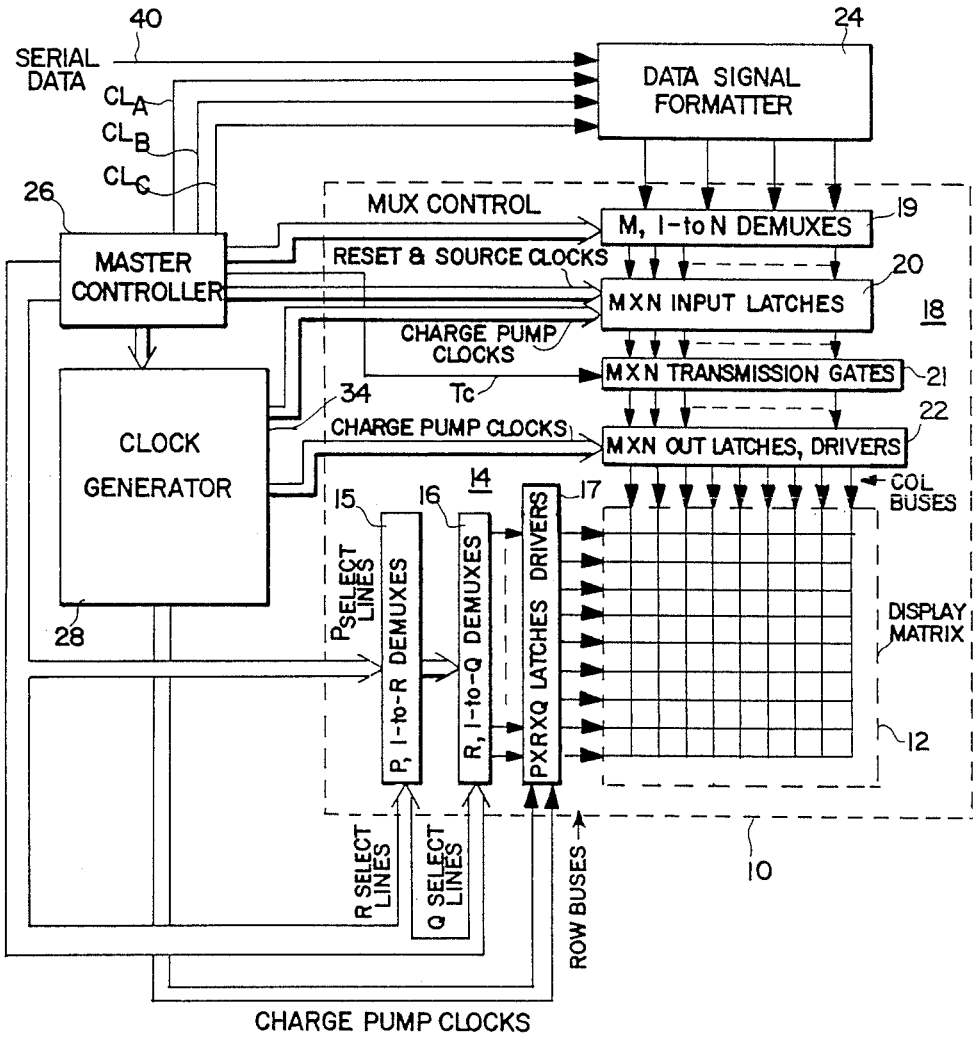
FIG. 1A is a block diagram of a flat panel display apparatus including integrally fabricated data commutating apparatus embodying the present invention.

Referring to FIG. 1A, a self scanned liquid crystal display system is shown in block form. This system includes a self scanned display array circumscribed by the broken line 10, and support electronics including a data signal formatter 24, a master controller 26 and a clock signal generator 28. The display array 10 includes a display matrix 12, horizontal scanning circuitry 14 and data commutating circuitry 18.

The display matrix 10 includes a plurality of P x Q x R horizontal busses and a plurality of M x N vertical data lines, where M, N, P, Q and R are integers. A transistor switch and liquid crystal display element (pixel) is located at the intersection of each horizontal bus and vertical data line. The control electrodes of the respective transistors are coupled to the horizontal busses. The conduction path of each transistor is coupled between a liquid crystal display element and a column bus. The liquid crystal display elements are capacitive elements and are capable of storing charge, i.e. they will store a potential. In the operation of this system, a potential is sequentially applied to the horizontal busses to turn on the matrix transistors a row at a time. Concurrently with a row of transistors being turned on, display data for that particular row of display elements is applied to the column busses. The display data is coupled to the respective display element capacitances via the matrix transistors and then the transistors in the row are turned off. The display data is stored on the display elements for a frame period during which time the respective data potentials determine the state of illumination or transmissibility of the respective display elements. After a frame period (the period required to address all of the horizontal lines) the horizontal row is again addressed and new display data is applied to the row of display elements.

Display data to be applied to the matrix is applied in serial form to terminal 40. This data is formatted into M parallel signals for application to the array demultiplexer 19. During each line interval the demultiplexer 19 converts the M parallel signals into M x N parallel signals corresponding to the M x N column busses. Since the demultiplexer converts M signals into M x N signals, the multiplexer must be capable of switching in, at most, 1/Nth of a line period. The M x N parallel signals are coupled to a plurality of M x N input latches 20. These latches are operated so as to minimize the response time of the demultiplexer.

The demultiplexing of the M parallel signals representing a line of data and the loading of this data into the input latches 20 occupies the majority of one line period.

The data in the input latches 20 are coupled, via transmission gates 21, to a second plurality of M x N output latches 22. This coupling is performed in a relative small percentage of a line period. The data are stored in the output latches 22 for approximately the next subsequent line period at which time the data are applied to the column busses for application to a row of matrix display elements. The matrix display elements in the particular row addressed have approximately a full line period to accept the applied data. Three features of this data commutating arrangement are (1) the number of data lines which are required to be taken off the self scanned array are reduced from M x N to M; (2) a period of approximately one line time is available to adjust the data potential of each array display element; and (3) as will be demonstrated below, the circuitry may be fabricated using TFT's of relatively low carrier mobility material and yet handle the relatively fast input data rate.

The horizontal scanner 14 includes a two level demultiplexer 15, 16 and a latch/driver 17 which includes a latch driver for each horizontal bus. P parallel scanning signals are coupled to the demultiplexer 15. In the simplest form of operation, the P scanning signals each provide a scanning pulse of 1/Pth of one active frame interval in mutually exclusive time periods. These P scanning signals are converted in demultiplexer 15 into P x R parallel scanning signals each of which provides a scanning pulse of 1/(P x R)th of one active frame interval and which occurs in mutually exclusive time periods. The P x R parallel signals are coupled to the demultiplexer 16 which develops P x R x Q parallel scanning signals. The P x R x Q parallel scanning signals each provide a scanning pulse of duration approximating a horizontal line interval. These pulses may be constrained to occur in mutually exclusive time periods or as will be demonstrated below scan pulses applied to successive horizontal rows may overlap.

The P x Q x R scanning pulses are coupled to P x Q x R parallel latch/drivers. The parallel latch drivers provide push-pull energization to the horizontal busses and are specifically designed to be capable of rapid turn off of the horizontal busses.

The master controller 26 provides multiplexing control and transfer signals to the column bus commutator 18 and the horizontal scanning circuitry 14. In addition, the master controller provides control signals to the clock signal generator 28 which develops clocking signals to energize the latch circuits 20, 22 and 17. The master controller may include an oscillator, and logic circuitry (for example, a microprocessor) for counting pulses provided by the oscillator to generate the requisite control signals in the appropriate timing relation.

For the system to be described, the latch circuits are clocked, particular time intervals, with variable duty cycle clocks. Clock generator 28 is configured to provide both constant duty cycle and variable duty cycle clock signals.

Figure 1B:
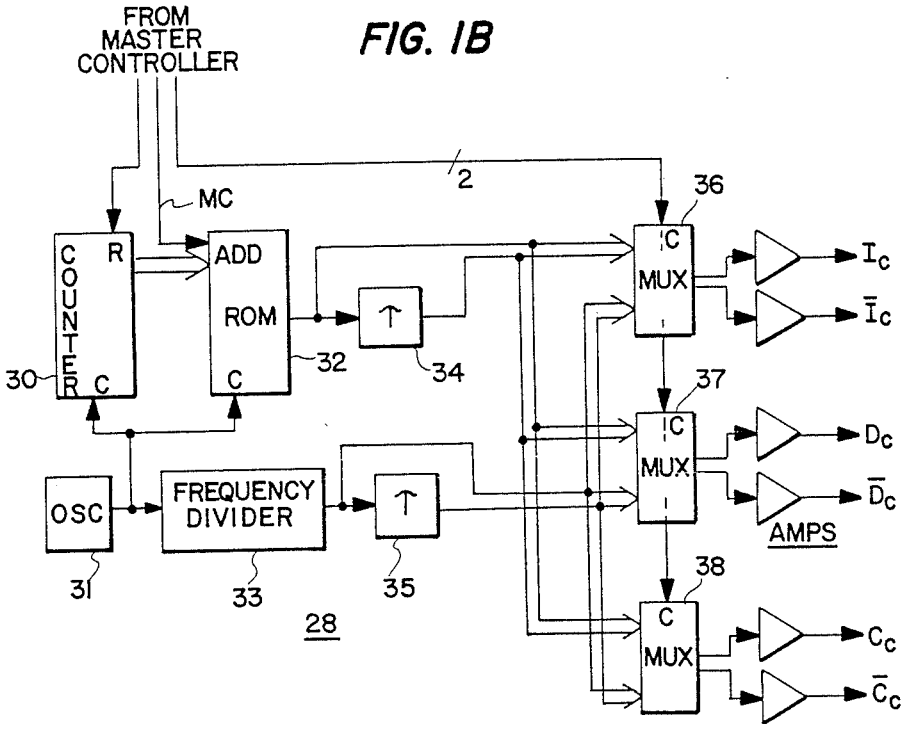
FIG. 1B is a block diagram of a clock generator circuit which may be implemented in the apparatus of FIG. 1A.

FIG. 1B illustrates exemplary circuitry which may be implemented for the clock generator 28. This circuitry includes an oscillator 31 which generates a constant frequency signal, for example, at 10 MHz. Oscillator 31 is coupled to a counting circuit 30 which provides ascending binary values for each cycle of the oscillator signal, for example, the sequence of values 0–127. These values are coupled to the address input of a read only memory (ROM) 32 having 128 memory locations preprogrammed with logic one and zero values. ROM 32 therefore provides a one or a zero value every 100 nanoseconds. More specifically, ROM 32 is programmed to output, for example, a 1 MHz waveform wherein the duty cycle varies from 10 percent to 100 percent and back to 10 percent for a sequence of addresses of 1–127. The general shape of this waveform is illustrated as waveform Ic' in FIG. 5. Of course, other waveshapes may be programmed in the ROM. In addition, additional address bits may be included such that different output sequences may be selected from ROM by the master controller. This is implied by the connection designated MC between the master controller 26 and the address input of ROM 32. Whenever a variable duty cycle clock waveform is desired, a reset pulse is applied by the master controller to the reset input of the counter 30 to start the sequence at a known point.

The output of the ROM 32 is coupled to a delay element 34 which in this example provides a delay of 500 nanoseconds. The output signals from delay element 34 and ROM 32 represent two-phase clock signals which are nonoverlapping at least during the intervals that the clock duty cycle is less than 50 percent. These two clock signals are coupled to respective first input ports of multiplexers 36, 37 and 38. A second pair of two phase clock signals having a constant duty cycle are coupled to respective second input ports of multiplexers 36, 37 and 8.

Multiplexers 36, 37 and 38 are controlled by the master controller 26 to apply either the constant duty cycle or variable duty cycle clocks to their respective output terminals. The multiplexer output terminals are coupled to driver/amplifiers which amplify the respective clock signals to the appropriate potential values.

The constant duty cycle clock signals are developed by coupling the output signal of oscillator 31 to a frequency divider 33 which divides the 10 MHz signal by, for example, 10 to provide a 1 MHz clock signal. This signal is coupled to the delay element 35 which delays the clock signal by, for example, 500 nanoseconds. The output signals provided by the divider 33 and delay element 35 represent a pair of two phase clock signals.

Figure 2:
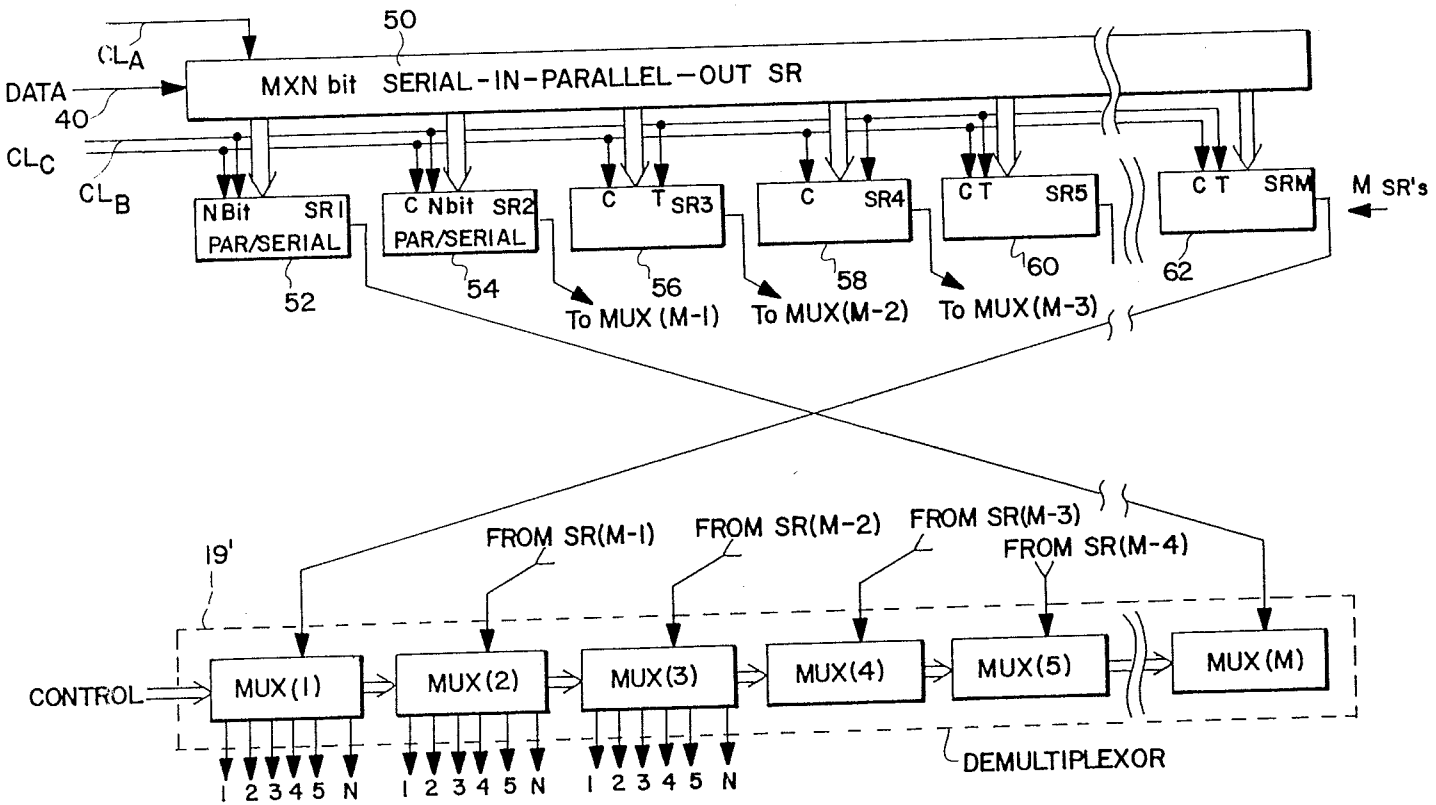
FIGS. 2 and 3 are partial block and partial schematic diagrams of demultiplexing circuitry which may be implemented in the FIG. 1 apparatus.

Refer next to FIG. 2 which illustrates an exemplary data formatter which may be used as the formatter 4 in FIG. 1. The formatter includes a serial-input-parallel-output shift register 50 and M parallel-input-output shift registers 52–62. Video data, which is assumed to be in sampled data form and representative of bilevel bright or dark picture information is applied in serial form to terminal 40. One line of video data is composed of M x N samples where M and N are integers. This video data is clocked into register 50 one horizontal line at a time at the video data rate responsive to clock signal $CL_A$. Clock signal $CL_A$ is synchronized to the video data rate. After a horizontal line of video data is clocked into register 50, the line of video data is transferred in parallel into the M parallel-input-serial-output registers 52–62 responsive to a transfer signal $DL_B$. The parallel transfer operation occurs in a relatively small portion of a line interval, i.e. in one or two cycles of the video data rate. After the parallel transfer, register 50 is conditioned to accept the next occurring horizontal line of video data.

During the time that register 50 is accepting the next subsequent line of video data, the M parallel-input-serial-output registers 52–62 read out the current video data therein to the demultiplexer 19'. Data is serially read out of the registers 52–62 in parallel, under the control of clock signal $CL_C$ Since there are M registers reading out data in parallel, nd the video data must be read out in at most one horizontal line time, the minimum read out rate of registers 52–62 is approximately N/TH where TH is a line period, assuming demultiplexing occurs during an entire line period. The minimum rate of clock $CL_C$ is N/TH, however, as will be demonstrated below, the frequency of clock signal $CL_C$ is actually about twice N/TH.

The respective serial output terminals of registers 52–62 are coupled to respective serial input terminals of M, 1-to-N demultiplexers MUX(M)–MUX(1) comprising demultiplexer 19'. In the exemplary system of FIG. 2, it is assumed that video data for a horizontal line is arranged so that first occurring data corresponds to data for display on the left side of the display and data occurring last corresponds to data for display on the right side of the display. After a line of data is loaded into register 50, the first and last occurring data reside in the right and left ends of register 50 respectively and, thus, the first and last occurring video data is transferred into registers 62 and 52 respectively. Demultiplexers MUX(1)–MUX(M) are arranged as shown to apply data to the display column busses from left to right. Therefore, the data is coupled from registers 62–52 to demultiplexers MUX(1) to MUX(M) respectively to properly orient the data for display. Alternatively, if it is inconsequential whether the information is mirrored about a vertical axis, or if the video data is input in reverse order, then registers 52–62 may be coupled to demultiplexers MUX(1)–MUX(M) respectively.

Figure 3:
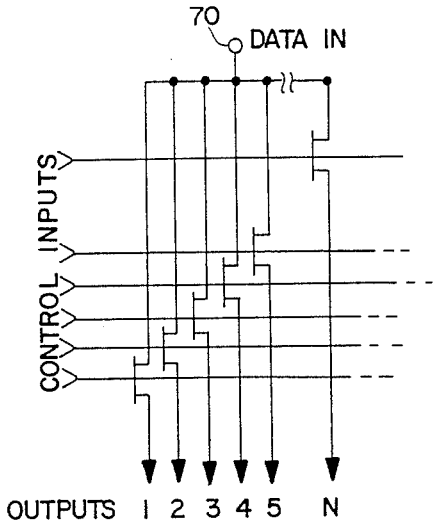

FIG. 3 illustrates, in schematic form, the configuration of one of the demultiplexers shown in block form in FIG. 2. The MUX includes a plurality of thin film field effect transistors, TFFET's, of single conductivity type, fabricated of low carrier mobility material (e.g. amorphous silicon). The respective gate electrodes of the TFFET's are coupled to respective control lines to which logic control potentials are applied to condition respective one's of the transistors to conduct to the exclusion of the remaining transistors. For example, the control potentials may be provided to sequentially scan the plurality of transistors so that each transistor is conditioned to conduct (once per line interval) to the exclusion of the remainder of the transistors. One electrode of the principal conduction path of each TFFET is coupled to the data input terminal, 70, of the demultiplexer and the other electrode of the principal conduction path of the respective TFFET is coupled to a respective one of the output terminals 1-N of the demultiplexer. The particular one of the TFFET's that is currently conditioned to conduct couples the video data concurrently applied to the input terminal 70, to its respective output terminal. The conditioning of particular TFFET's into conduction occurs at a rate commensurate with the rate of application of video data to terminal 70, i.e. the control potentials change at the rate at which registers 52–62 read out video data.

In order to fabricate the self scanned array with an expectation of reasonable yield, and in order that column busses, and ergo pixel elements, have a desirable pitch, it is necessary to minimize the number of transistors and interconnecting lines of the array. To this end, the demultiplexers are designed to provide only single ended drive to the input latches. Further, because the latches are driven single ended, and because the demultiplexers and latch transistors are fabricated with low carrier mobility material, the time required to change the state of the latch is relatively long. In order to reduce the switching time of the input latch, it is designed to include a reset transistor to reset the latch to a preferred state before video data is applied to the latch. The reset transistor is arranged so that the output connection to which video data is applied to the latch will be in a high state. Thus, if the video data represents a high state, the state of the latch is not required to change. Conversely, if the video data represents a low state, the state of the latch is required to change.

This arrangement produces the fastest latch state change for the following reasons. The reset transistor is coupled to the latch circuit in a configuration such that it operates in a common source mode to pull down the potential of an output connection of the input latch rather than in a source follower mode to pull up the potential of an output connection of the input latch. Operating in the common source mode to pull down the potential of the output connection, the gate-source potential of the transistor remains constant and, therefore, the current conducted by the reset transistor to discharge the output connection is substantially constant. Conversely, were the reset transistor operated as a source follower (common drain amplifier) to pull up the potential of an output connection of the input latch, the gate-source potential of the reset transistor would decrease as the potential of the output connection increased, effecting a time dependent decrease in the current conducted by the reset transistor to charge the output connection. Thus, for like control potentials applied to the gate electrodes of reset transistors operated in the common-source and source-follower modes, the common-source arrangement will effect faster resetting of the latch due to its constant current operation.

The demultiplexing transistor is coupled to the output connection of the input latch opposite the output connection to which the reset transistor is coupled. Prior to application of video data to the demultiplexers, all of the input latches are reset to the condition wherein the output connections to which the demultiplexing transistors are coupled are in a high state. Thus, the demultiplexing transistors never have t charge the input latches to a high state, that is the demultiplexing transistors do not operate in the source follower mode. The demultiplexing transistors are only required to discharge the output connection of the input latch on the occurrence of video data being in a low state and this discharging is performed in the faster common source mode. Were the input latch not reset to the foregoing preferred state, the demultiplexing transistors would be required to alternately operate in the common-source and source-follower modes for video signals corresponding to low and high states. Under this set of conditions, the demultiplexing rate would be limited by the slower source-follower mode. This in turn would require an increase in the number of demultiplexers and input data lines on the self scanned array.

Output latches are included for the following reasons. The column buffers or drivers are relatively large devices and present relatively large capacitive loads to the circuitry driving them. If the column drivers were driven by the input latches through transmission gates, the transmission gates would alternately operate in the common-source and source-follower modes. The time required of the transmission gates to energize the column buffers in the source follower mode is too long to provide acceptable performance. A latch on the other hand, operated with variable impedance loads, can relatively rapidly drive the column buffer input capacitance. In addition, the latch can be arranged to present relatively small input capacitance, and, thus, may be relatively easily driven thru the transmission gates. (Note that transmission gates are required somewhere in the commutating circuitry to isolate the column busses during the relatively long intervals that a new line of data is applied to the array.)

Figure 4:
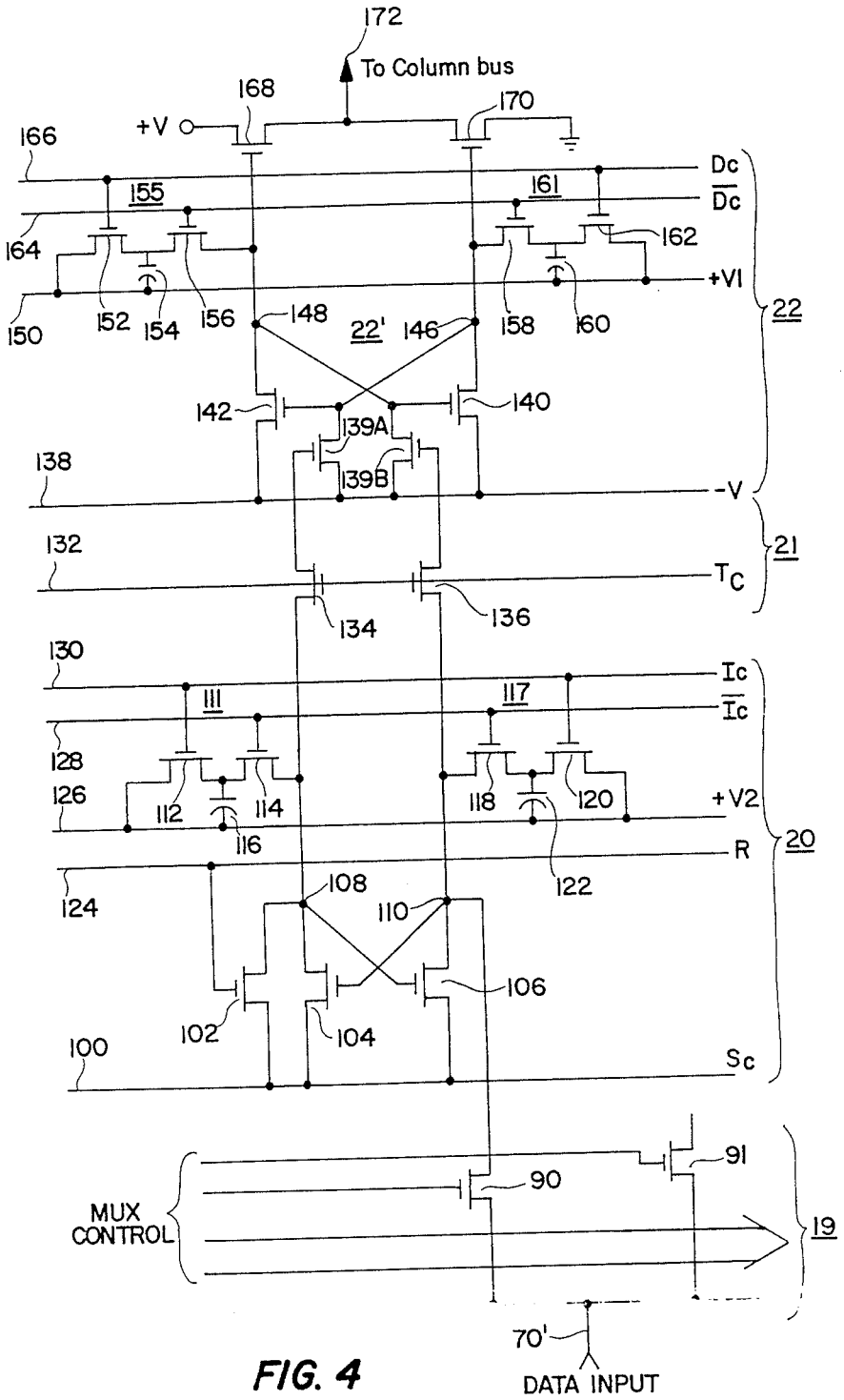
FIG. 4 is a schematic diagram of latch circuitry for driving one column bus of the display apparatus.

FIG. 4 illustrates the structure of the input latches, the transmission gates and the output latch and driver circuitry corresponding to one vertical data display bus. All of the transistors in the structure are assumed to be TFFET's fabricated with low carrier mobility material (e.g. amorphous silicon) and will be referred to hereinafter simply as FET's. In addition, for descriptive purposes, the transistors will be assumed to be enhancement, n-type devices. However, the principals of operation of the circuitry are not meant to be limited to field effect devices, but in general, are applicable to structures employing, for example, bipolar devices.

The input latch includes the cross coupled FET's 104 and 106 having respective source electrodes coupled to bus 100, drain electrodes coupled to output connections 108 and 110 respectively and gate electrodes coupled to output connections 110 and 108 respectively. A reset FET 102 has source and drain electrodes respectively coupled to bus 100 and output connection 108, and a gate electrode coupled to reset bus 126. FET's 108 and 110 have switched capacitor load circuits 111 and 117 coupled at output connections 108 and 110 respectively.

The switched capacitor load circuit 111 (117) includes the serially connected FET's 112, 114 (118, 120) coupled between the DC bus 126 and output connection 108 (110). A capacitor 116 (122) is coupled between the interconnection of transistors 112, 114 (118, 120) and a point of DC potential, which for convenience of illustration, is shown to be bus 126 in the drawing. Input data is coupled to the latch output connection 110 via a multiplexing FET 90 (corresponding to, for example, one of the transistors illustrated in FIG. 3) and determines the state of the latch. The input latch produces complementary logic output states at its output connections 108 and 110 determined by the logic state of the input data or a logic one potential applied to the reset bus 124. That is, a reset pulse will condition FET 102 to a conducting state, pulling output connection 108 to a low state and causing output connection 110 to attain a high state. The high state at output connection 110 regeneratively conditions FET 104 to conduct and latch or hold the circuitry in this state. Subsequently, if a video sample corresponding to a high state is applied, via FET 90, to the output connection 110, the state of the latch will not change. Alternatively, if a video sample corresponding to a low state is applied to the output connection 110, this low state will tend to turn off FET 104.

Switched capacitor load circuits 111, 117 are included to permit varying the gain of the latch. The series connected FET's 112, 114 (118, 20) are alternately conditioned to conduct by clock signals IC coupled to the gate electrodes of FET's 112 and 120 and clock signal $\bar{I}C$ coupled to the gate electrodes of FET's 114 and 118. When FET's 112 and 120 are conditioned to conduct, they charge capacitors 116 and 122 toward the DC potential +V2 applied to bus 126. Subsequently, FET's 112 and 120 are turned off and FET's 114 and 118 are conditioned to conduct. During this time interval the charge stored on capacitors 116 and 122 are coupled to output connections 108 and 110 as operating currents for the cross coupled FET's 104 and 106.

Textbook switched capacitor theory teaches that the effective impedance of a switched capacitor structure similar to FET's 112, 114 and capacitor 116 approaches that of a resistance having a value of $1/Cf_c$ Ohms where $f_c$ is the clocking frequency and C is the value of the capacitance. The FET's 112 and 114 in the FIG. 4 circuit do not have ideal switch characteristics assumed by switched capacitor theory but the arrangement does produce a resistive impedance albeit at a different value than $1/Cf_c$. For a constant frequency on clock signals Ic, $\bar{I}c$, the resistance value, and thus the gain of the latch circuit may be varied to greater and lesser values by decreasing and increasing the duty cycle of the clock waveforms respectively. The advantage of varying the latch gain will be described below, after the remainder of FIG. 4 is described.

The complementary output signals on connections 108 and 110 are coupled to transmission gates 134 and 136 respectively. Transmission gates 134 and 136 are controlled by a transfer pulse Tc applied to their respective gate electrodes via bus 132. Once a complete line of video data has been multiplexed into the input latches 20, the transmission gates are conditioned to conduct and apply the respective output potentials to the gates of FET's 139A and 139B which form the input circuitry of the output latches 22'. The transmission gates 134 and 136 are then turned off until the next line interval. The transmission gates 134 and 136 may be turned off before the output latch completely changes state provided sufficient time has elapsed to store the output potentials generated by the input latch on the inherent parasitic capacitance of the gate electrodes of FET's 139A and 139B. Thereafter, even though the transmission gates 134 and 136 are nonconducting, the stored potential on the gate electrodes of FET's 139A and 139B will continue to effect a state change of the output latch 22'.

The output latch 22' includes input FET's 139A, 139B, cross coupled FET's 142, 140 and switched capacitor load circuits 155, 161. The source electrodes of FET's 139A, 139B, 140 and 142 are coupled to the DC bus 138. The drain FET's 139B and 142 are coupled to output connection 148 and the drain electrodes of FET's 139A and 140 are coupled to output connection 146. Switched capacitor load circuits 155 and 161 are respectively coupled to output connections 148 and 146. Switched capacitor load circuit 155 (161) includes the serially coupled FET's 152, 156 (162, 158) and capacitor 154 (160) coupled between the interconnection of the serially coupled FET's and a point of fixed potential. The gate electrodes of FET's 152, 156 (162, 158) are respectively coupled to clock busses 166 and 164 to which clock signals $D_c$ and $\bar{D}_c$ are applied for varying the output latch gain.

The input signal applied to the output latch is double ended, that is one of the FET's 139A and 139B will be conditioned to conduct while the other will be conditioned to be non-conducting. FET's 139A and 139B are arranged, when conducting, to pull down the respective output node to which its drain electrode is connected. Thus, FET's 139A and 139B only operate common-source mode. Due to the double ended input, output latch 22' is symmetric and, therefore, need not be reset before application of input data.

The output latch 22' provides complementary output signals on connections 148 and 146 which are respectively coupled to the gate electrodes of FET's 168 and 170 configured as a push-pull driver. FET's 168 and 170 are serially coupled between relatively positive and relatively negative DC potentials. The interconnection 172 of FET's 168 and 170 is coupled to a vertical column bus in the display matrix.

The busses 100, 124, 126, 128, 130, 132, 138, 150, 164 and 166 are common to all of the M x N circuits on the array.

Figure 5:
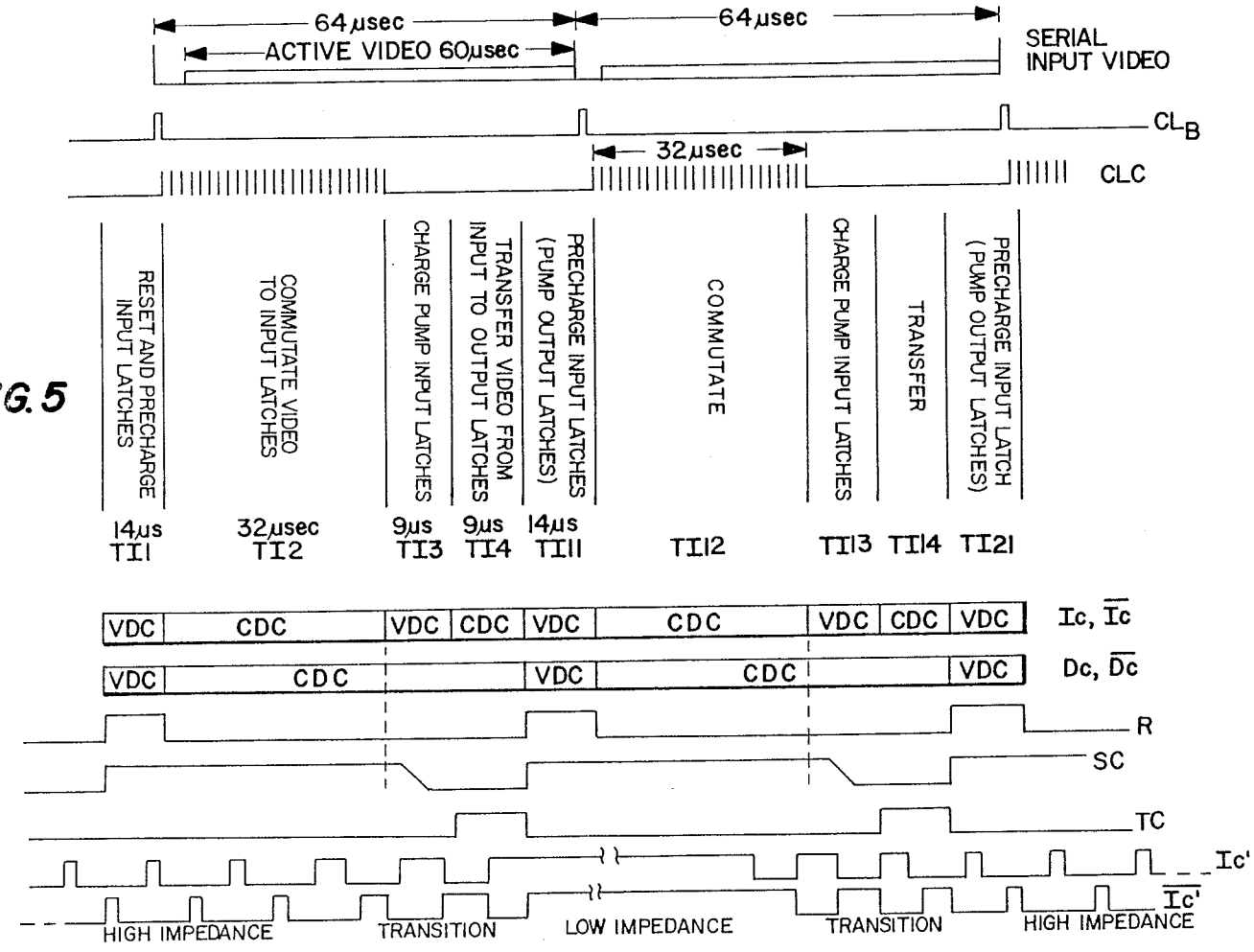
FIG. 5 is a timing graph of the sequence of operation of the commutating apparatus.

The system timing is illustrated in FIG. 5 which timing is based on the following exemplary assumptions. A horizontal line interval is 64$\mu$ sec. in duration of which active video information occupies 60 $\mu$ sec. There are 1024 video data samples per line interval and a corresponding number of column busses in the display matrix. The number M of multiplexers and of parallel-input-serial-output registers is 32. The number N of outputs per multiplexer is 32 and the number of samples coupled to each of the registers 62–52 is 32.

Since 1024 video samples occur in 60 $\mu$ sec., register 50 is clocked at a 17 MHz rate by clock signal CLA. Thirty-two microseconds are allotted to commutate the video data via 32 channels, thus, the commutation rate, and the clocking rate of registers 52–62, ($CL_c$) is 1 MHz.

In FIG. 5 the topmost waveform designated serial input video represents the line format of the serial video data showing two successive lines. At the end of a line period, a line of video data is loaded into register 50 and respective samples are available on the parallel output connections. A pulse occurs on clock signal $CL_B$ transferring the video data in register 50 to registers 52–62. After this transfer, the registers 52–62 are clocked in parallel by clock signal $CL_C$ providing a 32$\mu$ sec. burst of 32 pulses of a 1 MHz clock signal. During this 32 $\mu$ sec. interval, 32 video samples are serially coupled to each of the 32 multiplexers at the 1 MHz rate and the multiplexer control signals scan the multiplexers at the 1 MHz rate to couple their respective 32 video samples to 32 different input latches. About 9$\mu$ sec. after the commutating interval the transfer clock, Tc, provides a pulse of about 9$\mu$ sec. during which time data is coupled from the input latches to the output latches.

As indicated before, the input and output latches are provided with switched capacitor loads so that latch gain may be varied. Such gain variation is performed twice per line interval for the input latches and once per line interval for the output latches. After data has been transferred from the input to the output latches (time intervals designated T11, T111, T121) the input latches are reset and charged to a preferred state. The resetting or charging time is enhanced by varying the latch gain. The latch gain is varied by changing the switched capacitor loads clock frequency or duty cycle. The blocked waveform designated Ic, $\bar{I}_c$ represents the input latch clocks, that is the switched capacitor load clocks. The time intervals denoted VDC and CDC denote variable gain and constant gain periods respectively. The gain of the input latches is also varied during intervals TI3, TI13 immediately after the commutation intervals TI2, TI12. In between the variable gain intervals, the clocks $I_c$, $\bar{I}_c$ are operated to provide high gain, that is they are operated at low frequency or low duty cycle, or alternatively if the circuits exhibit low leakage currents the clocks Ic, $\bar{I}_c$ may be stopped.

The switched capacitor load clocks $D_c$, $\bar{D}_c$ of the output latches are operated to provide variable gain during timing intervals T11, T111, T121, etc. immediately after the transfer intervals T14, T114. In between these intervals of variable gain the clock signal $D_c$, $\bar{D}_c$ are operated in a constant high gain mode or halted all together if the level of leakage current permits.

The waveform $S_c$ illustrated in FIG. 5 represents the potential coupled to the bus 100 of FIG. 4 which bus provides source potential for the cross coupled FET's 104, 106. The potential $S_c$ varies between approximately −2 volts and −5 volts. During the precharge intervals T11, T111, etc., potential $S_c$ is raised to −2 volts to lessen the conductivity of transistor 106 to lessen the average precharge or reset time of the input latch. It has been found that the latch gain may be enhanced, or the latching switching time lessened, by ramping down the source potential. It is most advantageous to do this after sample commutation and during the intervals T13, T113, that the input latches are charge pumped.

The latch operation proceeds as follows. During reset, potential Sc is set from its operating level of −5 volts to −2 volts which transition will lessen the conductivity of both FET's 104 and 106. The reset clock R is pulsed high turning on FET 102. The potential of the reset pulse is selected to be large enough so that the FET 102 tends to dominate the influence of FET's 104 and 106. If output connection 108 is in a low state, it remains low. Alternatively, if output connection 108 is high, it is pulled to the −2 V potential on bus 100. Concurrently, the regenerative action of the latch will tend to pull output connection 110 high. At this time, if the load impedances of the latch is high, that is, the effective resistance of the switched capacitor load 111 is large, there will be little current to support the high potential at output connection 108, permitting the reset transistor 102 to pull it down rapidly. Concurrently, the effective resistance of the switched capacitor load 117 will also be high, and consequently will provide little current to pull output connection 110 high with reasonable speed. Thus, once enough time has elapsed for output connection 108 to be pulled low, it is advantageous to condition the switched capacitor loads to provide lesser resistance or greater drive current to pull the output connection 110 high. Thereafter, the switched capacitor loads 111 and 117 may be returned to the high impedance condition or if the circuit leakage is sufficiently low, they may be conditioned to exhibit substantially infinite impedance by halting the clocks $I_c$ or $\bar{I}_c$ in the low state. The preferred mode of operation is to halt the clocks during this interval, i.e. when video signal commutation is performed. The waveform designated $I_c'$, $\bar{I}_c'$ are time expanded waveforms representing the clocks $I_c$, $\bar{I}_c$ during the variable impedance intervals.

After the reset interval, the video signal commutation begins. The video signal applied to the data input terminal 70 has exemplary potential values of positive five and negative five volts for high and low states respectively. During the commutation period, FET 90 is conditioned to conduct for one microsecond. If the video signal is high, the latch remains in the reset state. If the video signal is low, output connection 110 is pulled toward −5 volts, however, in the 1μ sec. commutation interval, the potential at connection 110 does not attain a potential much less than −2 volts. First consider that switch capacitor loads 111 and 117 are operating in the high resistance state. As connection 110 goes low, output connection 108 is pulled toward a high state. The one microsecond commutation time is sufficient to initiate latch regeneration so that it will continue to change state even after FET 90 is turned off. Next consider the preferred mode where the switched capacitor loads 111 and 117 are in the infinite impedance state, i.e. clocks $I_c$ and $\bar{I}_c$ are stopped in the low state. If the is low, output connection 110 is pulled toward −5 volts through FET 90. With loads 111 and 117 exhibiting infinite impedance, there is no drive current to support a high potential at output connection 110, and, thus, it can be pulled low relatively rapidly thereby shortening the required commutation time. However, since no drive current is provided, output connection 108 cannot be pulled high. Output connections 108 and 110 are both low, but connection 110 is at a lower potential than connection 108 since connection 108 is clamped at the −2 volts potential SC, but connection 110 is pulled toward −5 volts. It is not necessary that connection 110 be pulled all the way to −5 volts. It is sufficient that connection 110 be set to −2.3 volts to insure that the latch attain the desired state when load current is again applied via loads 111 and 117.

Regardless of whether the switch capacitor loads are operating in the high impedance state or infinite impedance state, neither output of the latch will attain an 15 output potential significantly more positive than zero volts during the 1 μ sec. interval that a −5 volt video signal is coupled thereto. This represents a power loss between the demultiplexer input connection and the output connections of the input latch. This power loss is acceptable because it is in effect traded off against a bandwidth enhancement.

The bandwidth enhancement occurs in part because the source potentials of the cross coupled transistors are raised to −2 volts, thereby lessening the output potential swing on connection 110 that must be effected via demultiplexing transistor 90 to produce a change of state of the latch. Secondly, bandwidth is enhanced because there is little load current to oppose the pull down of connection 110 via demultiplexing transistor 90. Thirdly, at least in the preferred mode, during computation the cross coupled FET's are effectively removed from the circuit by the bearing conditions and, thus, transistor 90 is not occasioned to fight any regenerative action of the latch.

After the completion of the commutation interval TI2, the input latches enter the charge pump phase TI3 and the power loss is recovered. At the beginning of this interval, the switched capacitor loads 111 and 117 are conditioned to the high gain state, that is to provide load current through high effective resistances. At the same FET"S 104 and 106, is changed from −2 volts to −5 volts. Pulling the potential on the source electrodes of FET's 104 and 106 to −5 volts conditions FET's 104 and 106 into conduction. The FET having the higher gate potential rapidly pulls its drain potential low (and turns the other FET off) due to the limited load current provided by loads 111 and 117. Alternatively, if the FET having the higher gate potential cannot pull its drain potential sufficiently low to completely turn off the other FET, it will still pull it to a low enough potential to establish the ultimate state of the latch. About two microseconds are allotted for this sensing action. Then the switched capacitor clocks $I_c$ and $\bar{I}_c$ are modulated to provide low load impedance and high drive current. The output connection that is conditioned to go high charges relatively rapidly during this interval, however, it is precluded from reaching its maximum potential for the following reason. Refer to FIG. 4 and assume output connection 108 is to go to the high state, that is FET's 104 and 106 are to be in the nonconducting and conducting states respectively. When the load circuits 111 and 117 are conditioned to exhibit low load resistance, the ratio of the effective load resistance to the output resistance of FET 106 is too small to establish the potential at output connection 110 sufficiently low to prevent FET 104 from conducting. The current conducted by FET 104 prevents connection 108 from reaching the maximum potential available. Therefore, after the load circuits 111 and 117 have exhibited the low resistance or low gain state for several microseconds, which is sufficient time to charge the respective outputs to a relatively high potential, the load circuits 111 and 117 are again conditioned to exhibit high resistance (high gain). In this state, the ratio of the switched capacitor load impedance to the FET 106 output impedance is sufficiently high that the potential established on the gate electrode of the FET 104 is sufficiently low to ensure that FET 104 does not conduct and its drain electrode can charge to the maximum available potential.

At the end of interval TI3 the complementary output voltages of the input latches have substantially attained their penultimate potentials. These output potentials are coupled to the output latches by the transmission gates 134, 136 during interval T14. Thereafter, the transmission gates 134 and 136 are turned off, isolating the input latches from the output latches, and the input latches undergo the reset operation in preparation for receiving video data from the next horizontal line of display data.

The output latches 22' operate in a sensing mode during intervals T11, T111, T121, etc. and a hold mode between these intervals. The sensing intervals are approximately 14 μs in duration, during which time the output states of the output latches may be in transition. The hold mode intervals are approximately 50 μsec. in duration, during which time valid data is applied to the display matrix. Thus, the display elements have approximately 50 μsec. to accept and store new display data.

In the sensing intervals, the switched capacitor loads 155 and 161 of the output latches are modulated to sequentially provide high load impedances, low load impedances and then high load impedances to effect fast state changes of the latches in a manner similar to that described for the input latches. However, it is unnecessary to ramp the source potentials of the cross coupled FET's 140 and 142 of the output latch. At the end of the sensing interval and during the hold interval the switched capacitor loads of the output latch are maintained in the high impedance condition, or infinite impedance condition if the leakage is sufficiently low, since the output latch is driving a purely capacitive load (the gates of the buffer driver).

Figure 6:
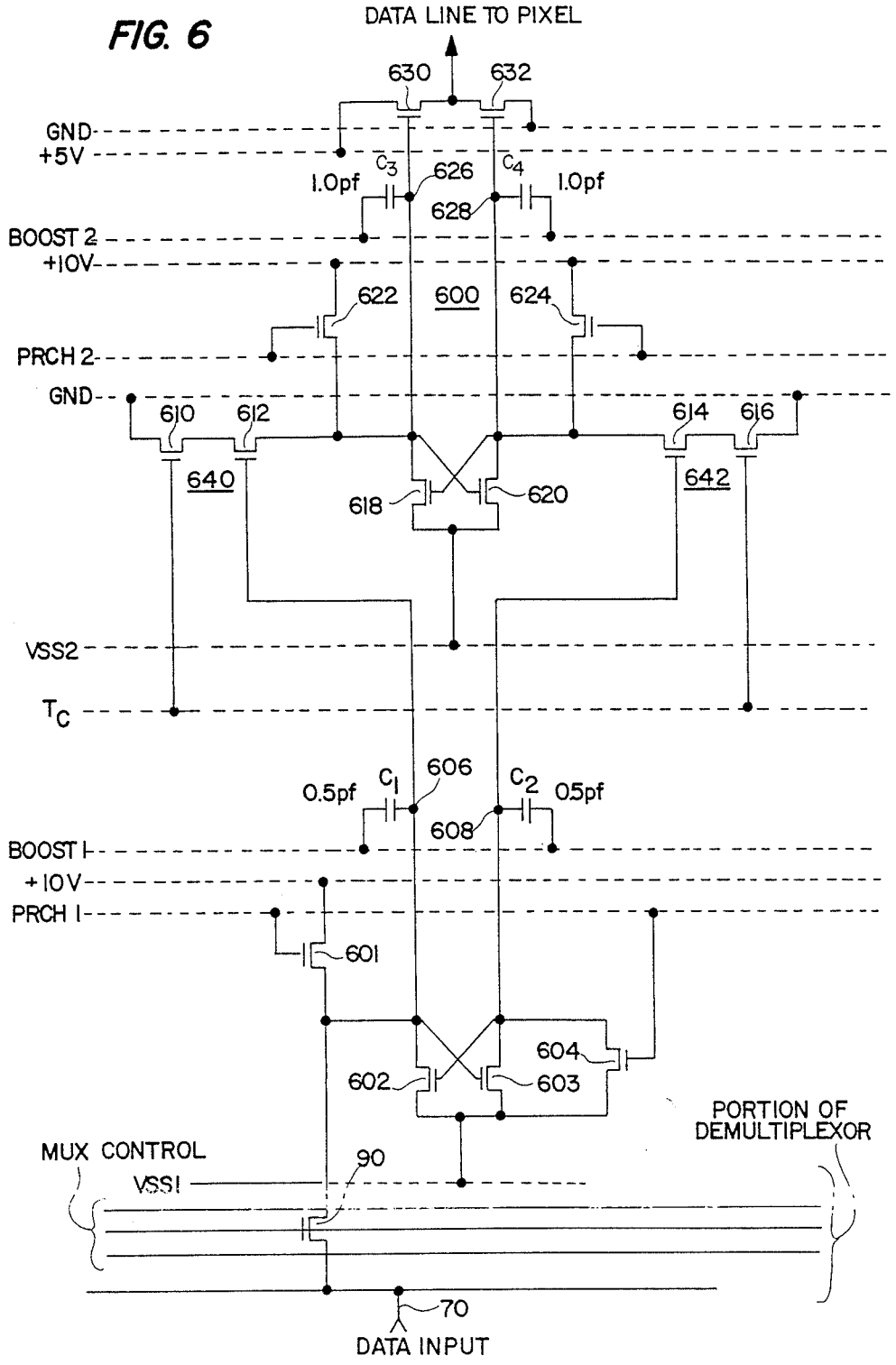
FIG. 6 is a schematic diagram of alternate latch circuitry for driving one column bus of the display apparatus.
Figure 7:
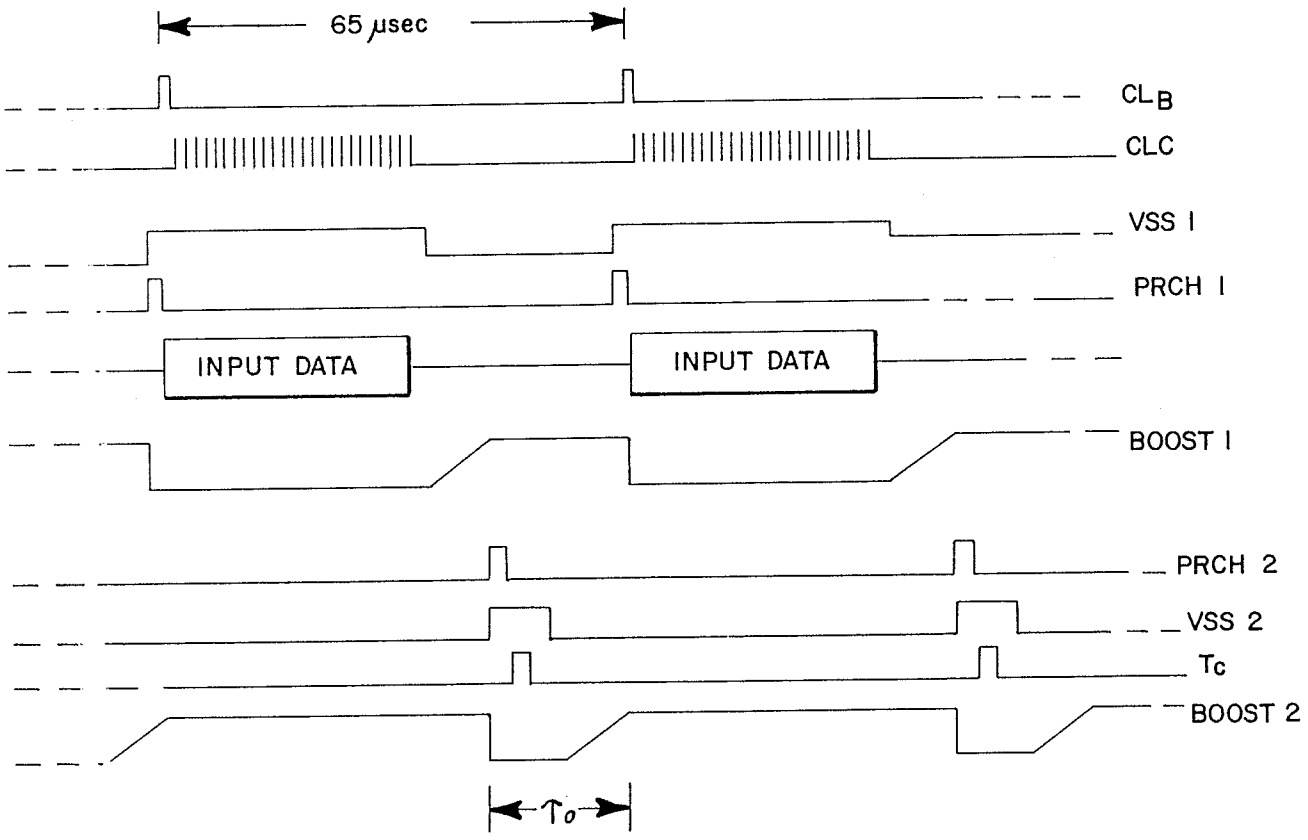
FIG. 7 is a timing graph useful in describing the operation of the FIG. 6 circuitry.

FIG. 6 illustrates a preferred embodiment of the data input structure. The requisite control signal waveforms applicable to the FIG. 6 circuitry are illustrated in FIG. 7. These waveforms can readily be generated by one skilled in the art of circuit design, hence the details of their generation will not be discussed.

The circuitry of FIG. 6 includes a data input terminal 70 and a multiplexing FET 90 as in FIG. 4. The FET 90 is coupled to an input latch consisting of FET's 601-604 and capacitors C1 and C2. FET's 90 and 601-604 have exemplary channel widths of 50 micrometers. FET's 602 and 603 form a cross coupled latch pair, having respective source electrodes coupled to the bus VSS1. The drain electrode of FET 602 and the gate electrode of FET 603 are coupled to an output terminal 606, and the drain electrode of FET 603 and the gate electrode of FET 602 are coupled to a second output terminal 608. Capacitors C1 and C2 are respectively coupled between the bus BOOST 1 and terminals 606 and 608 respectively. FET 601 has its conduction path coupled between a dc supply, e.g. 10 V, and output terminal 606, and its gate electrode coupled to bus PRCH 1. FET 604 has its conduction path coupled between bus VSS1 and output terminal 608, and its gate electrode coupled to bus PRCH1.

The operation of the input latch proceeds as follows. Just prior to the application of video input data to the data input terminal 70, indicated by the active part of clock CLC in FIG. 7, the output terminals 606 and 608 are precharged to, e.g. 10 and 7 volts respectively. This is accomplished by applying a 15 volt pulse to bus PRCH1 and a 7 volt pulse to bus VSS1. The pulse on bus PRCH1 turns on FET's 601 and 604 which respectively couple 10 and 7 volt potentials to the terminals 606 and 608. FET 602 remains off since its gate-source potential is zero at this time. FET 603 is biased on since it has a 3 volt gate-source potential. However, since the potentials at the source and drain of FET 603 are both 7 volts, FET 603 is non-conducting. After approximately 2–3 microseconds, the potential on bus PRCH1 is returned to zero volts turning off FET's 601 and 604. The 10 and 7 volt potentials on terminals 606 and 608 are retained thereon by virtue of charges stored on capacitors C1 and C2. The potential on bus VSS1 is maintained at 7 volts which in effect removes the FET's 602 and 603 from the circuit. Subsequent to FET's 601 and 604 turning off, video data is applied to the data input terminal at a one mega Hertz rate and respective ones of the multiplexing FET's 90 are turned on. If the video data coupled to terminal 606 is a high value, the state of the latch does not change. Conversely, if the video data is a low value, the potential on terminal 606 is discharged through FET 90, operation in the common-source mode. Desirably, terminal 606 should discharge to zero volts, however, it is only necessary that the potential on terminal 606 be discharged to about a volt or two below the potential on output terminal 608. In fact, if the circuitry is realized using metal-insulator-silicon or MIS Processing, once the potential on the drain of FET 602 is pulled down to a potential value which is a threshold potential less than its gate potential it will conduct between its drain and bus VSS1, and resist further discharge of terminal 606. It has been found to be advantageous to cause terminal 606 to be discharged to 4 volts if the video data is low. Thus, whether the video data is high or low, a 3 volt differential will exist between the gate electrodes of FET's 602 and 603. This potential difference is sufficient to condition the latch into regenerative action.

After input data has been applied to all of the input latches (32 microseconds after bus PRCH1 is returned to zero volts) bus VSS1 is returned to zero volts (see FIG. 7). At this point the FET 602 or 603 having the greater drain potential conditions the gate of the opposite FET to begin discharging its respective output terminal.

Once bus VSS1 is returned to zero volts, bus BOOST 1 is energized with a ramped voltage having a slope of approximately 3 volts per microsecond and a terminal value of approximately 10 volts. This voltage is coupled to terminals 606 and 608 via capacitors C1 and C2 respectively. A virtual constant load current, $C\Delta V/\Delta t$, is thereby coupled to the latch output terminals to pull the requisite output terminal to a high potential, where $\Delta V/\Delta t$ is the rate of change of the potential on bus BOOST 1. The opposite output terminal is discharged through the regenerative action of the latching FET's 602 and 603. Bus BOOST 1 is held at its terminal high voltage until the input latch is again precharged to accept new data for the subsequent video line.

Output terminals 606 and 608 are coupled to inputs of transmission gates 640 and 642, which in this case are a type of NAND gate. Transmission gate 640 (642) consists of the serially connected FET's 610 and 612 (614 and 616) between ground potential and output terminal 626 (628) of output latch 600. The gate electrodes of FET's 612 and 614 are coupled to output terminals 606 and 608 respectively. The gate electrodes of FET's 610 and 616 are coupled to bus TC. When bus TC is pulsed high, FET's 610 and 616 couple the source electrodes of FET's 612 and 614 to ground potential. Since output terminals 606 and 608 provide complementary output potentials, one of FET's 612 and 614 will be conditioned to conduct and establish the state of the output latch 600.

Output latch 600 includes a cross coupled pair of FET's 618 and 620 having respective source electrodes coupled to bus VSS2 and respective drain electrodes coupled to output terminals 626 and 628 respectively. A second pair of FET's (622 and 624) are respectively coupled between a point of positive potential (e.g., 10 volts) and output terminals 622 and 624, and have their respective gate electrodes coupled to bus PRCH2. The FET's 610-624 have exemplary channel widths of 100 micrometers. In addition, capacitors C3 and C4 are coupled between bus BOOST2 and output terminals 626 and 628. In operation, output latch 600 is first precharged and then data is applied. Precharging is performed at a time such that the output latch will be ready to accept new data shortly after new data is stablized in the input latch. Precharging is initiated by applying a pulse (for example 15 V) to bus PRCH2 and turning on FET's 622 and 624. In addition, a pulse of 10 volts is applied to bus VSS2. As shown in FIG. 7, this occurs shortly after the potential ramp on bus BOOST1 reaches its terminal potential.

FET's 622 and 624 charge output terminals 626 and 628 to 10 volts in approximately two microseconds. Bus PRCH2 is then returned to ground potential. FET's 618 and 620 are non-conducting since their gate, drain and source potentials are all at 10 V. After bus PRCH2 is returned to ground potential, bus TC is pulsed for about two-three microseconds and one of FET's 612 and 614 will discharge or partially discharge one of the output terminals 626 and 628 in accordance with the state of output terminals 606 and 608 of the input latch. Since no load current is supplied to output terminals 626 and 628, they may be rapidly discharged. The potential on bus TC is then returned to ground after which the bus VSS2 is returned to ground, biasing one of FET's 618 and 620 into conduction and initiating regenerative action in the output latch 600. At this point a ramped voltage is applied to bus BOOST2 to provide effective load currents to the latch output terminals and raise the output potential of the terminal determined to be in the high state. The potential applied to bus BOOST2 is similar in slew rate and terminal value to the potential applied to BOOST1. The potential applied to bus BOOST2 is held at its terminal voltage (100) until the precharge cycle is reinitiated at which point it is returned to ground potential.

The time, $\tau 0$, required to precharge the output latch and complete a state change of the output latch is approximately 10 microseconds. Stable output data is therefore available for 54 microseconds per line (row) of data.

Output terminals 626 and 628 are coupled to the gate electrodes of FET's 630 and 632 which form a push pull driver stage. Exemplary channel widths of FET's 630 and 632 are 800 micrometers.

As configured in FIG. 6, the circuitry inverts the video signal. This inversion can be eliminated by reversing the relatively negative and relatively positive bus connections to FET's 630 and 632.

The commutating system as described is limited to applying two level video brightness signals to the display device. This system has application in integrated displays exhibiting grey scale at least in the following context. T. Gielow, R. Hally, D. Lanzinger and T. Ng in a paper entitled "Multiplex Drive of a Thin-Film EL Panel", published in the May 1986 SID International Symposium, Digest of Technical Papers (pages 242–244), and G. G. Gillette et al. in U.S. patent application Ser. No. 943,496 entitled "Display Device Drive Circuit", filed Dec. 19, 1986, describe drive circuits for a matrix display device which includes a counter for each column of the display. The counters are set with brightness count values to establish grey scale potentials for the pixels. These counters are coupled to transfer gates which respectively couple an analog voltage ramp to all of the column busses. The respective counters turn off their corresponding transfer gates when the ramp voltage corresponds to the value in the counter. These analog values are stored on the bus capacitances for the duration of the line interval and are available for setting the potential of the pixel elements. The commutating circuitry described herein may be implemented to apply the requisite binary brightness count values to the counter circuits, which brightness count values corresponds to video signal.

Figure 8:
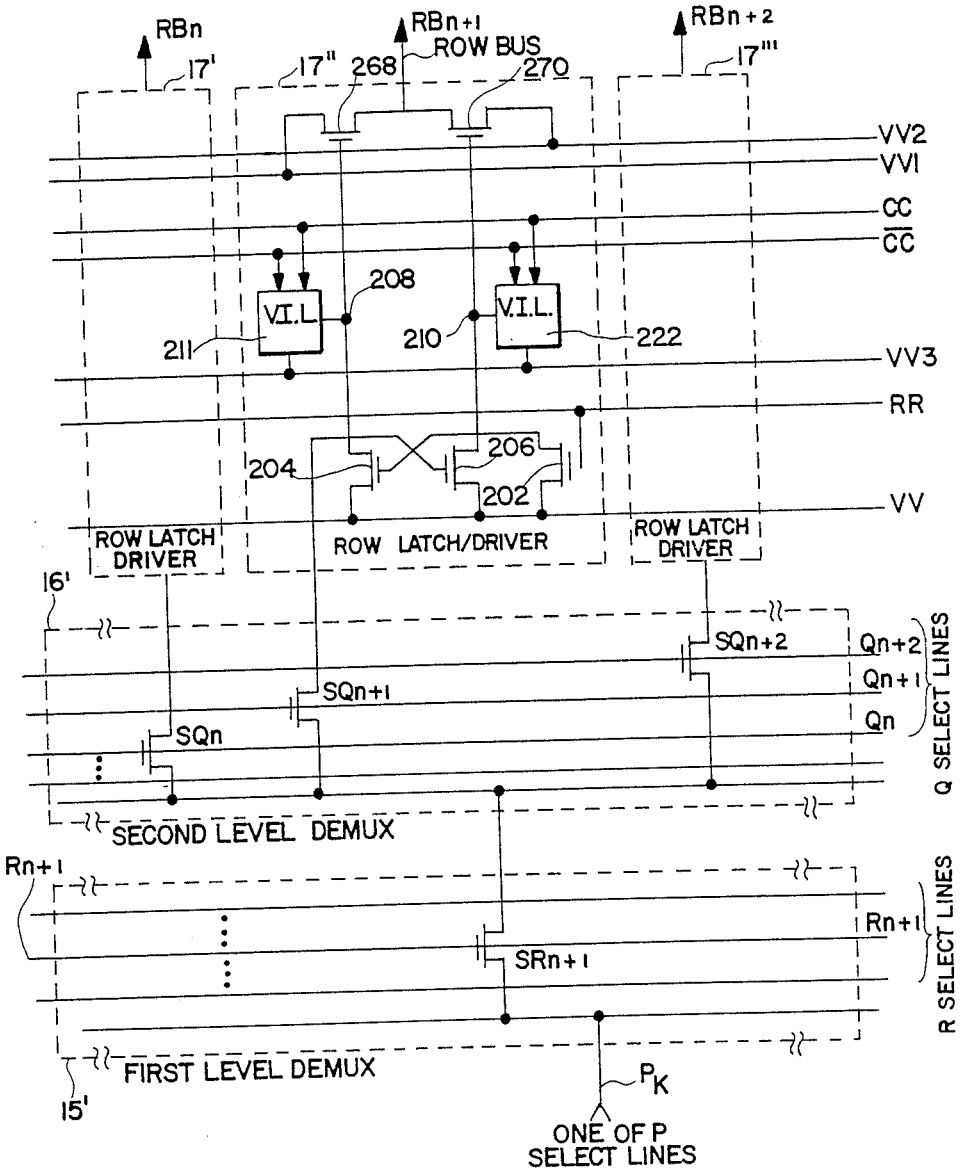
FIG. 8 is a schematic diagram of row selecting demultiplexers and latch driver circuitry.

FIG. 8 shows the row select circuitry for one row bus. This circuitry includes a portion of the 1-to-R demultiplexer 15' and the 1-to-Q demultiplexer 16' each of which are constructed similar to the demultiplexer shown in FIG. 3. If the number of row busses is assumed to be 512 then the first level demultiplexer 15' may consist of eight 1-by-8 demultiplexers and the second level demultiplexer 16' may consist of sixty four 1-by-8 demultiplexers. With this arrangement, the number of address connections necessary to address 512 row busses is 24 (i.e. three times eight). Note where system speed is not the critical parameter the two level demultiplexer may be replaced by a shift register scanner. But even where speed is not critical, the two level demultiplexer provides advantages over a shift register scanner in that it permits addressing the row busses in any arbitrary sequence where a shift register scanner does not.

In FIG. 8, the box designated 15' is meant to represent a portion of one of the eight 1-by-8 demultiplexers of the first level demultiplexer 15. The box designated 16' is meant to represent a portion of one of the sixty four 1-by-8 demultiplexers of the second level demultiplexer 16. Three of the eight switches are shown in the demultiplexer 16', which switches are coupled respectively to three successive latch/drivers 17', 17' and 17'''. The details of latch/driver 17' are shown in schematic form and is seen to resemble the input data latches, except that the output connections 208, 210 of the latch driver 17' are coupled directly to the gate electrodes of driver FET's 268 and 270 respectively.

Figure 9:
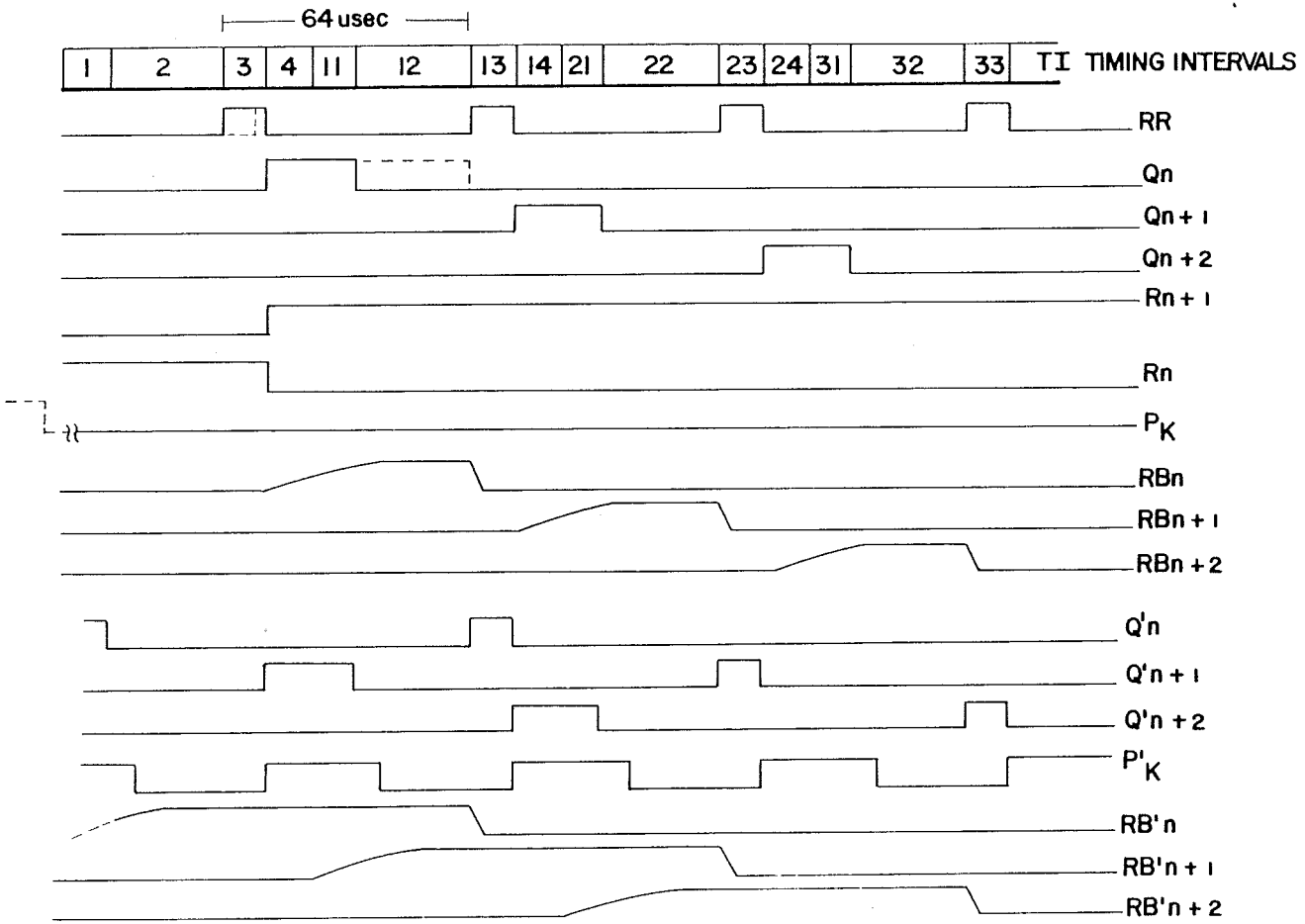
FIG. 9 is a timing graph of the sequence of operation of the row selection apparatus.

The basic operation of the latch driver 17' will be described with reference to the waveforms of FIG. 9 wherein the topmost illustration designated TI corresponds to the timing intervals illustrated in FIG. 5.

A desirable criterion of operation is that the pixel FET's be turned off rapidly at the end of a line interval, that is before data on the column busses changes. This rapid turn off is effected by conditioning reset FET 202 to rapidly change the state of the latch/driver from the on state to the off state in concert with changing the load impedance of the latch. RESET FET 202 is pulsed on by a reset pulse either just prior to the timing interval T14 when video data is transferred from the input to the output data latches, or during the early portion of T14, before any significant data transfer has taken place.

The latch/drivers are operated with variable impedance loads similar to the input data latches. It is convenient to reset the latch/drivers during the interval T13, T113 in order to share the variable load control clocks $I_o$, $\bar{I}_o$ with the data latches. The reset pulses, RR, in FIG. 9, are shown coincident with the intervals T13, TI13 for this reason.

Reset FET 202 is coupled to output connection 210 and desirably operates in the common-source mode to pull connection 210 low. If this is to turn the driver stage (268, 270) off, then the drain connection of FET 270 is coupled to a relatively positive potential VV2 and the source connection of FET 268 is coupled to relatively negative potential VV1.

The reset pulse RR is coupled in common to all of the latch/driver circuits during each line interval. Therefore, the latch output connection 208 of each latch/-driver is high at the beginning of each line interval. A latch/driver is conditioned to the on state by pulling the latch output connection 208 low. This is effected by concurrently conditioning FET's $SQ_{n+1}$ and $SR_{n+1}$ into conduction and conditioning the $P_K$ select line to a low state. The conditioning pulses are shown as $Q_{n+1}$, $R_{n+1}$ and PK in FIG. 9. The latch/driver output waveforms for latch/drivers 17', 17' and 17''' are illustrated as $RB_n$, $RB_{n+1}$ and $RB_{n+2}$ respectively.

In this mode of operation the select pulses Q, R and P are applied to initiate a state change, after the reset operation, in the latch/driver addressed. At this time, (T14, T114,) the variable impedance load circuits 211 and 222 of the latch circuits are in the high impedance state so that the demultiplexer FET's can rapidly pull output connection 208 low. The load circuits are then conditioned (T11, T111) to generate with variable rate clocks to rapidly charge the output connection 210 to its maximum output drive potential. The select pulses $Q_i$, $R_i$ and $P_i$ need not be applied for the entire line interval, but only long enough to effect a state change.

When the latch/driver is subsequently reset by reset transistor 202, the variable load impedances are similarly sequenced from high to low to high impedance states to reduce the latch/driver reset time.

The aforedescribed mode of row selection requires that the latch/driver currently addressed switch from low-to-high and then high-to-low in one line time. The time required for these two transitions limits the amount of time available to perform a data change at the pixel elements. It is possible, with little noticeable affect on the information displayed, to perform a row select one (or more) line periods in advance of the normal row select and to hold the row bus high for two (or more) line intervals instead of one. (Note that the resultant data in a row of pixels is determined at the instant the row bus is turned off.) This mode affords the pixels substantially a full line interval to accept new data.

In this mode of operation, the reset transistors 202 cannot be used and the latch/drivers must be both set and reset via the demultiplexers. Since resetting (turning off) the latch/driver is more critical than setting (turning on) the latch/driver, the demultiplexer FET's operate in the source follower and common source modes to set and reset the latch/driver respectively. During the setting and resetting intervals, the latch load impedances are modulated as in the previous example. The only change required of the circuitry is that potential VV1 be made relatively positive and potential VV2 be made relatively negative. In addition, the select pulses $Q_i$ and $R_i$ must be applied during the set period and again during the reset period and the select pulses $P_i$ must alternate between set (positive) and reset (relatively negative) potentials. Waveforms illustrating this operation are illustrated with primes in FIG. 9. In the illustrated example, each line row is conditioned to an "on" voltage for approximately two line intervals. This may be extended to larger numbers of line intervals with appropriate selection of address signals P, Q and R.

If 512 lines of data are processed in an interlaced manner of 256 lines per field, the data may be displayed in a psuedo non-interlaced form by applying each line of data to two lines of display elements. For example, during odd fields, rows 1 and 2, 3 and 4, 5 and 6, etc., may be respectively energized concurrently. Then during even fields rows 1, 2 and 3, 4 and 5, 6 and 7, etc., are respectively energized concurrently.

Figure 10:
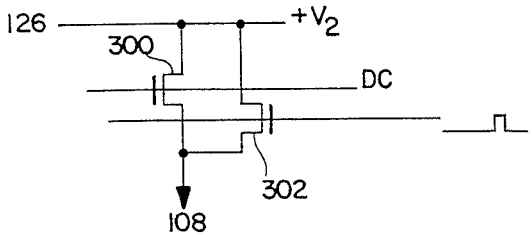
FIG. 10 is a schematic of an alternate variable impedance load device.

The exemplary circuits disclosed in FIGS. 4 and 8 include switched capacitor circuits as variable load devices, however, other variable load circuits may be substituted therefore. For example, a single FET may be substituted for the switched capacitor circuit and the gate potential varied. This FET is sized such that for a gate potential sufficiently high to provide the desired penultimate latch output potential, the source-drain impedance will correspond to the high impedance state. To develop the low impedance state a greater gate potential is applied. FIG. 10 illustrates a further variable impedance load circuit which may be substituted for the switched capacitor circuits. This load circuit consists of two parallel connected FET's 300 and 302 which would be connected between, for example, bus 126 and output connection 108 in FIG. 4. FET 300 has a constant DC potential applied to its gate electrode, and provides a high impedance resistance to the latch via its drain-source conductance path. FET 302 is configured to have lower drain-source resistance and is conditioned to conduct in parallel with FET 300 during intervals that low load impedance is required.

What is claimed is:

1. Apparatus for scanning a matrix of the type including column and row busses for applying potentials to matrix elements and including latch elements integrated with said matrix for coupling potentials to ones of said column or row busses, said latch elements improved to enhance the switching speed thereof, comprising:

a pair of cross coupled transistors including first and second transistors having respective first electrodes coupled to a common bus, having respective second electrodes coupled to respective output connections and having respective control electrodes, the control electrodes of said first and second transistors being coupled to the second electrodes of said second and first transistors respectively;

first and second variable impedance load elements respectively coupled to the second electrodes of said pair of cross coupled transistors, said variable impedance load devices having control electrodes for applying potentials to control the impedance exhibited thereby;

means coupled to apply input signals to said pair of cross coupled transistors; and means coupled to the control electrodes of said variable impedance load elements for conditioning said load elements to exhibit in sequence relatively high, relatively low then relatively high impedances to effect a state change of said latch, responsive to input signals applied to said pair of cross coupled transistors.

2. The apparatus set forth in claim 1 wherein said variable impedance load elements include:

a load transistor having a conduction path coupled between a source of supply potential and a second electrode of one of said pair of cross coupled transistors and having a control electrode; and said means for conditioning said load element to exhibit in sequence relatively high, relatively low then relatively high impedance includes a clock signal generator for providing clock pulses of varying duty cycle.

3. The apparatus set forth in claim 2 wherein said variable impedance load elements further include a further transistor having a principal conduction path coupled in series with said load transistor between said source of supply potential and said second electrode, and having a control electrode, and said means including a clock signal generator provides clock signals of varying duty cycle and different phase to the control electrodes of said load transistor and said further transistor.

4. The apparatus set forth in claim 3 wherein said variable impedance load element further includes a capacitor coupled between an interconnection of said load and further transistor and a point of fixed potential.

5. The apparatus set forth in claim 1 further including means coupled to said common bus for supplying a potential having a first value prior to application of said input signal and changing to a second value after application of said input signal, said second value conditioning said pair of cross coupled transistors into greater conduction than said first value.

6. The apparatus set forth in claim 5 wherein said variable impedance load elements include:

a load transistor having a conduction path coupled between a source of supply potential and a second electrode of one of said pair of cross coupled transistors and having a control electrode; and said means for conditioning said load device to exhibit high and low impedance includes means for selectively applying bilevel signals to the control electrode of said load transistor.

7. The apparatus set forth in claim 1 wherein said variable impedance load elements are switched capacitor load devices including at least first and second serially coupled transistors having a capacitance coupled between an interconnection of said first and second serially coupled transistors and a point of fixed potential.

8. Apparatus for scanning a matrix of the type including column and row busses for applying potentials to matrix elements and including latch elements integrated with said matrix for coupling potentials to ones of said column or row busses, said apparatus comprising:

a plurality of pairs of cross coupled transistors, each pair including first and second transistors having respective first electrodes coupled to a common bus, having respective second electrodes coupled to respective output connections and having respective control electrodes, the control electrodes of said first and second transistors being coupled to the second electrodes of the second and first transistors respectively;

a plurality of variable impedance load elements respectively coupled to the second electrodes of said pairs of cross coupled transistors, said variable impedance load devices having control electrodes for applying potentials to control the impedance exhibited thereby;

means including serially coupled first and second level demultiplexing means, coupled to said plurality of cross coupled transistors for applying input signals respectively thereto;

means coupled to the control electrodes for said plurality of variable impedance load elements for conditioning said load elements to exhibit in sequence relatively high, relatively low than relatively high impedances to effect a state change of said latch, responsive to input signals applied to said pair of cross coupled transistors; and means for coupling the second electrodes of respective cross coupled transistors to respective row busses.

9. Apparatus for scanning a matrix of the type including column and row busses for applying potentials to matrix elements and including latch elements integrated with said matrix for coupling potentials to ones of said column or row busses, said latch elements improved to enhance the switching speed thereof, comprising:

a pair of cross coupled transistors including first and second transistors having respective first electrodes coupled to a common bus, having respective second electrodes coupled to respective output connections and having respective control electrodes the control electrodes of the first and second transistors being respectively coupled to the second electrodes of the second and first transistors;

means coupled to said pair of cross coupled transistors for applying input signals thereto;

means coupled to said cross coupled transistors for selectively presetting the second electrodes of said transistors to predetermined potentials immediately prior to applying said input signals;

respective capacitors having respective first terminals coupled respectively to the second electrodes of said pair of cross coupled transistors, having respective second terminals coupled to a further bus and having respective capacitance values, C;

means coupled to said further bus for applying a potential which changes, at a rate $\Delta V/\Delta t$ for a predetermined interval after said input signals are applied, said potential conditioning said capacitors to supply currents equal to $C\Delta V/\Delta t$ to said cross coupled transistors during said predetermined interval, and to supply zero current for a further interval subsequent said predetermined interval and where $\Delta V$ is the change in potential per unit of time $\Delta t$;

means for coupling at least one of said respective-output connections to one of said column and row busses.

10. The apparatus set forth in claim 9 further including means for applying a signal to said common bus having a first state during intervals said input signals are applied to said latch element and a second state at least during intervals that said potential applied to said further bus is changing at said rate $\Delta V/\Delta t$.

* * * * *